US012532924B1

(12) United States Patent
Palladino

(10) Patent No.: US 12,532,924 B1
(45) Date of Patent: Jan. 27, 2026

(54) PREMATURE INFANT GARMENT

(71) Applicant: Luxie Charm, LLC, Cheshire, CT (US)

(72) Inventor: Christina Palladino, Cheshire, CT (US)

(73) Assignee: Luxie Charm, LLC, Cheshire, CT (US)

( * ) Notice: Subject to any disclaimer, the term of this patent is extended or adjusted under 35 U.S.C. 154(b) by 0 days.

(21) Appl. No.: 18/937,588

(22) Filed: Nov. 5, 2024

(51) Int. Cl.
*A41B 13/08* (2006.01)

(52) U.S. Cl.
CPC ..... *A41B 13/08* (2013.01); *A41B 2300/322* (2013.01)

(58) Field of Classification Search
CPC ..... A41B 13/005; A41B 13/08; A41D 11/00; A41D 13/1272; A41D 13/1281; A41D 27/201
See application file for complete search history.

(56) References Cited

U.S. PATENT DOCUMENTS 503,363 A * 8/1893 Bissinger ..... A41D 27/20 2/248
1,946,173 A * 2/1934 Miller ..... A41D 27/20 2/248
3,587,501 A * 6/1971 Cruden ..... A41F 1/02 112/475.25
4,578,062 A * 3/1986 Schneider ..... A41D 13/1245 604/174
4,747,413 A * 5/1988 Bloch ..... A41B 13/00 374/E13.002
6,477,710 B1 * 11/2002 Ojoyeyi ..... A41D 13/1236 2/254
8,690,835 B1 * 4/2014 Parris ..... A41D 13/1236 604/179
8,832,864 B1 * 9/2014 Braden ..... A41D 13/1272 2/114
10,555,568 B1 2/2020 Walker-Baldwin
2003/0177563 A1 * 9/2003 Reich ..... A41D 13/1263 2/75
2006/0253953 A1 11/2006 Williams
2007/0033700 A1 2/2007 Gonya
2007/0271672 A1 * 11/2007 Lentini ..... A41D 13/1245 2/69
2008/0184455 A1 * 8/2008 Blume ..... A41D 13/1281 2/114
2009/0293169 A1 * 12/2009 Wise ..... A41D 10/00 2/243.1
2010/0042051 A1 * 2/2010 Walker ..... A41D 13/1245 2/113
2010/0242150 A1 * 9/2010 Trouillot ..... A41D 13/1245 2/114

(Continued)

FOREIGN PATENT DOCUMENTS

GB 2409962 A 7/2005
WO 2020056280 A1 3/2020

*Primary Examiner* — Jillian K Pierorazio

(57) ABSTRACT

A garment for a premature infant includes a bodice from which two sleeves and two pant legs extend. The bodice includes a neck opening, with a refastenable seam that extends from the neck opening along a length of the bodice. At least one slit opening on the bodice is a finished opening that is not refastenable and does not coincide with any side seams of the bodice.

18 Claims, 5 Drawing Sheets

(56) References Cited

U.S. PATENT DOCUMENTS

| | | | | |
|---|---|---|---|---|
| 2010/0251454 | A1* | 10/2010 | Kiernan | A41D 13/1281 2/69 |
| 2012/0174285 | A1 | 7/2012 | Williams et al. | |
| 2012/0266349 | A1 | 10/2012 | Rolando | |
| 2014/0259272 | A1* | 9/2014 | Kiernan | A41D 13/1281 2/69 |
| 2015/0374048 | A1* | 12/2015 | Theodossiou | A41D 13/1245 2/114 |
| 2017/0055604 | A1* | 3/2017 | Clauder | A41D 13/1236 |
| 2019/0289923 | A1* | 9/2019 | Norton | A41D 1/062 |
| 2020/0068960 | A1* | 3/2020 | Oliver | A41D 13/129 |
| 2020/0107592 | A1* | 4/2020 | Janelle | A41D 13/1272 |
| 2020/0113257 | A1* | 4/2020 | Winner | A41D 13/1245 |
| 2022/0378120 | A1* | 12/2022 | Horak | A41B 13/005 |
| 2023/0029804 | A1* | 2/2023 | Paulasir | A41D 13/1245 |
| 2024/0237766 | A1* | 7/2024 | Wiggins | A41D 27/20 |

* cited by examiner

PREMATURE INFANT GARMENT

BACKGROUND OF THE INVENTION

Most baby clothing is sized proportionally to fit full-term babies. Even baby clothing that is considered "preemie" size has the same proportions as full-term baby clothing. However, babies that are born prematurely, before 37 weeks gestation and sometimes even earlier than 28 weeks gestation, have different body proportions than full-term babies. For example, premature babies proportionally have longer torsos and shorter arms and legs compared to full-term babies. As a result, conventional "preemie" size clothing often results in a poor fit.

Additionally, premature babies often have health challenges that require the babies' vital signs to be monitored in a neonatal intensive care unit. Wires from monitors are typically attached to the skin of a baby's chest or abdomen with adhesive patches. A temperature probe can also be placed on the baby's skin with an adhesive patch, with a wire connecting the temperature probe to a temperature regulator in an incubator. An umbilical catheter can be inserted into the baby's umbilical cord to deliver food and medicines. The clothing babies wear can interfere with the connectivity between medical devices and the baby, often resulting in a disruption in the monitoring process or a disruption in the delivery of food and medicine.

Pulse oximeters are often used to measure the amount of oxygen in a baby's blood through the skin. A pulse oximeter can be attached to a baby's hand or foot. Intravenous lines can also be placed in a baby's hand or foot to deliver food and medicines. Thus, an important feature in premature baby clothing is the ease of accessibility to the baby's hands and feet.

There is a need or desire for clothing that is designed to fit premature babies comfortably, that does not interfere with the connectivity between medical devices and the baby.

SUMMARY OF THE INVENTION

A garment for a premature infant, according to the invention, includes a bodice from which two sleeves and two pant legs extend. The bodice has a neck opening and a refastenable seam extending from the neck opening along a length of the bodice. At least one slit opening is located on the bodice. Wires or tubes can be fed through the slit opening to provide connectivity between medical devices and the baby. The slit opening is a finished opening that is not refastenable and does not coincide with any side seams of the bodice.

The garment may be a one-piece garment, such as a romper or sleeper. The refastenable seam suitably extends from the neck opening to one of the two pant legs and extends along a length of the pant leg. The garment may include a cuff at a distal end of each of the two pant legs. According to certain embodiments, the refastenable seam may extend from the neck opening to the cuff at the distal end of one of the two pant legs. The refastenable seam may include a zipper, such as a two-way zipper that can zip from each end. This refastenable seam may be the only refastenable seam in the garment.

According to some embodiments, the garment may include just one slit opening. According to other embodiments, the garment may include two slit openings. Three or more slit openings may be included in other embodiments. The slit opening or openings may be located on a front side of the bodice. Additionally or alternatively, the slit opening or openings may be located between the front side and the back side of the bodice, as long as the slit openings do not coincide with any side seams. The slit opening or openings may be between about 1 cm and 5 cm long, for example.

DETAILED DESCRIPTION OF THE INVENTION

Figure 1:
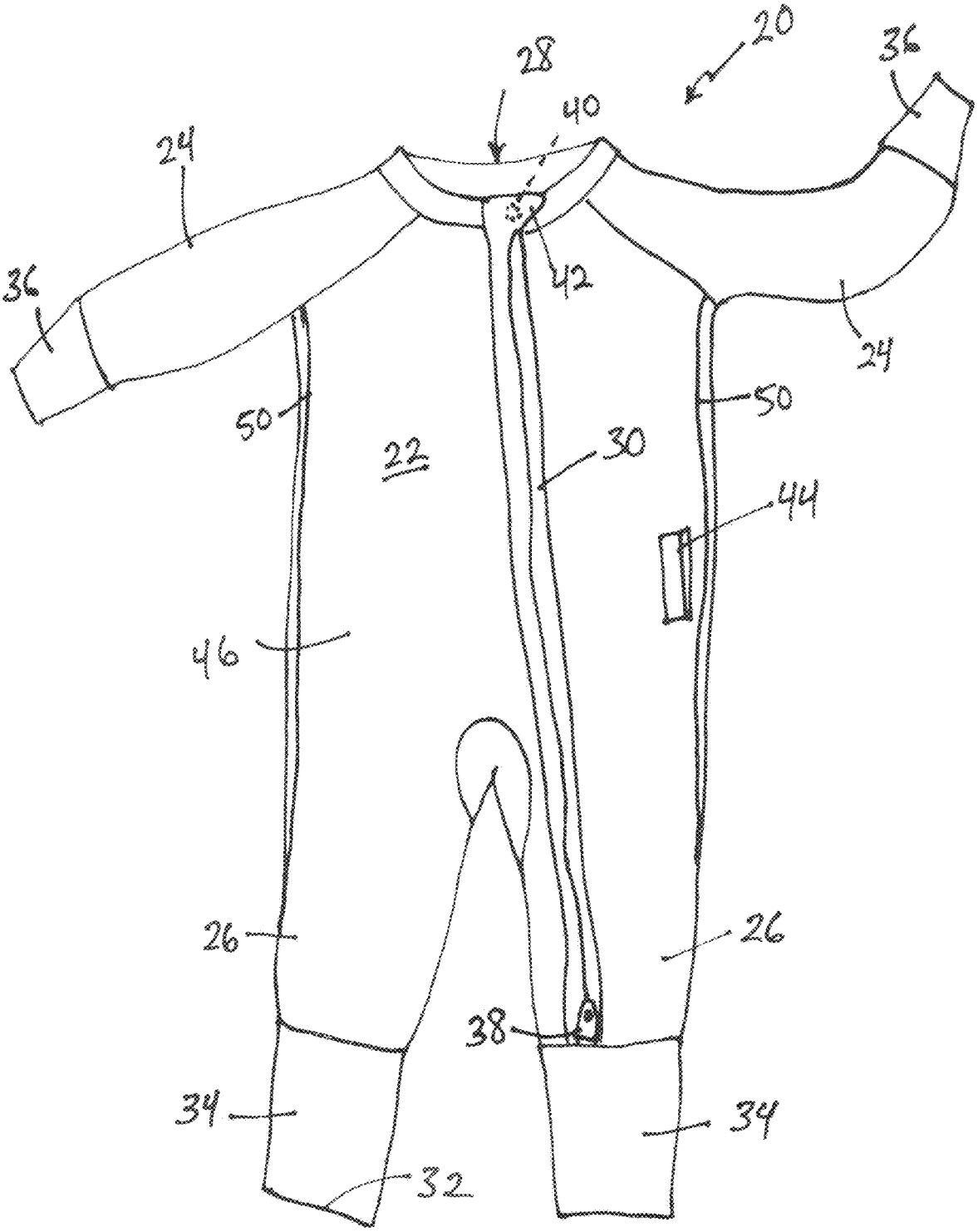
FIG. 1 is a front view of one embodiment of a premature infant garment.

One example of a premature infant garment 20 is illustrated in FIG. 1. The garment 20 includes a bodice 22, with two sleeves 24 and two pant legs 26 extending from the bodice 22. The sleeves 24 and pant legs 26 may be formed from the same piece of fabric as the bodice 22, or the sleeves 24 or pant legs 26 may be sewn to the bodice 22. The bodice 22 also has a neck opening 28. The garment 20 is suitably a one-piece garment, such as a romper or sleeper. The garment 20 may be formed of multiple panels of fabric sewn together to form the one-piece garment 20.

The garment 20 is generally smaller than baby clothing designed to fit full-term babies. In particular, the dimensions of the garment 20 are designed to comfortably fit a premature infant, with the sleeves 24 and pant legs 26 being short relative to a length of the bodice 22, compared to baby clothing designed to fit full-term babies. Smaller, tighter fitting clothing keeps the warmth in, which is especially important for premature infants, since keeping their temperature up is a key factor in promoting their growth.

The garment 20 includes a refastenable seam 30 that extends from the neck opening 28 along a length of the bodice 22. The refasteneable seam 30 may extend from the neck opening 28 all the way down the bodice to one of the pant legs 26, and may extend only partially down the pant leg 26 or all the way down to a distal end 32 of the pant leg 26. As shown in FIGS. 1-4, the garment may include a cuff 34 at a distal end 32 of each of the pant legs 26. The cuff 34 may be between about 3 cm to about 12 cm long, or between about 5 cm to about 10 cm long, and may be formed of the same material as the pant leg 26 or of a more ribbed material, for example. According to some embodiments, the refastenable seam 30 may extend from the neck opening 28 to one of the leg cuffs 34. The refastenable seam 30 allows a caretaker to easily dress and undress the baby. With the refastenable seam 30 extending down one of the pant legs 26, this configuration also allows a caretaker to change the baby's diaper without having to remove the entire garment 20 from the baby. Additionally, the cuffs 34 at the end of the pant legs 26 ensure that the baby's feet remain accessible for attaching intravenous lines or other medical devices.

The refastenable seam 30 may include a zipper 38 that runs essentially the full length of the refastenable seam 30. The zipper 38 may be a two-way zipper that can be opened and closed from the neck opening 28 as well as from the distal end 32 or cuff 34 of the pant leg 26. An additional fastener 40, such as a snap, may be included at one or both ends of the refastenable seam 30 for additional security. Additionally or alternatively, the neck opening 28 may include an extension of fabric 42 that extends from one side of the refastenable seam 30 to the other side of the refastenable seam 30, to cover the end of the refastenable seam 30 to protect the baby's skin from contact with the zipper 38 at the neck opening 28. Other types of refastenable closures may be used in place of a zipper 38, such as hook-and-loop fasteners, snaps, and adhesive strips, for example.

According to certain embodiments, the refastenable seam 30 is the only refastenable seam in the garment 20, unlike other baby garments that include refastenable seams along the sides of the garment. Embodiments that include just one refastenable seam 30 are designed to enhance comfort and durability, since refastenable seams are prone to coming undone and generally are not as comfortable as solid fabric.

In order to accommodate wires and tubes that are attached to the baby's skin, the garment 20 has at least one slit opening 44, which may be located on the bodice 22 and/or on either or both of the sleeves 24 and pant legs 26. The wires or tubes can be fed through the slit opening 44 to provide connectivity between medical devices and the baby.

Figure 2:
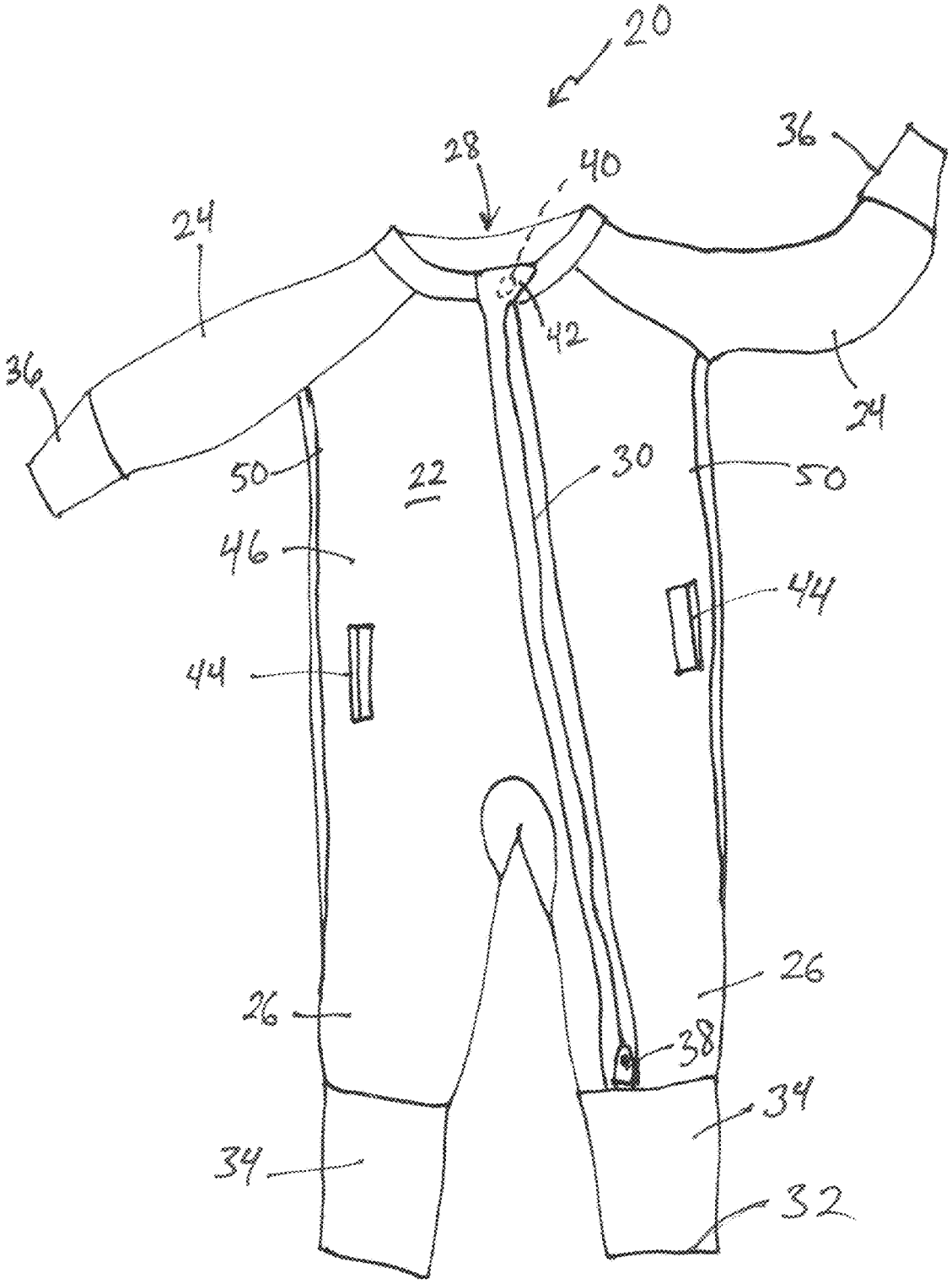
FIG. 2 is a front view of another embodiment of a premature infant garment.
Figure 3:
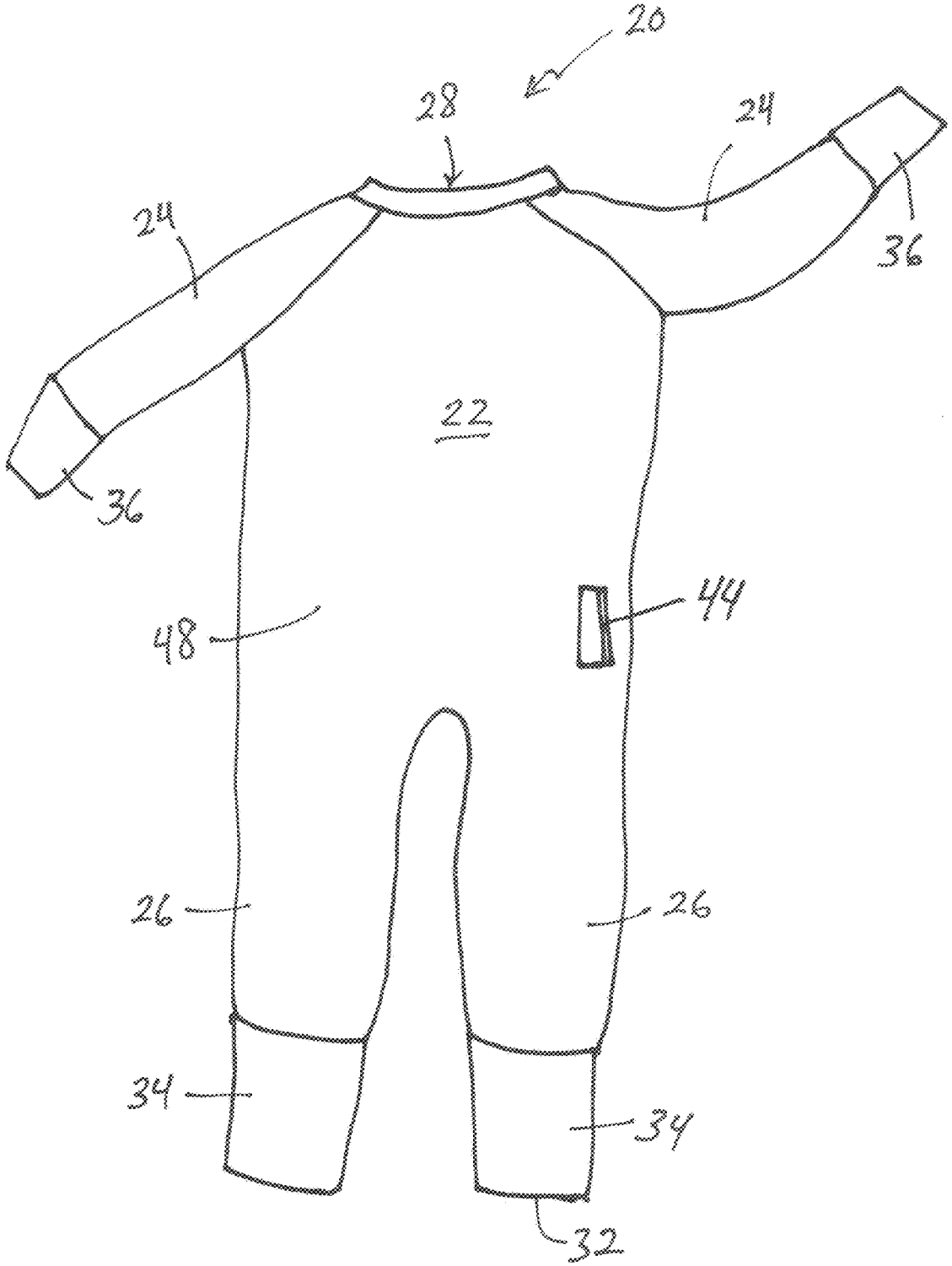
FIG. 3 is a rear view of one embodiment of a premature infant garment.
Figure 4:
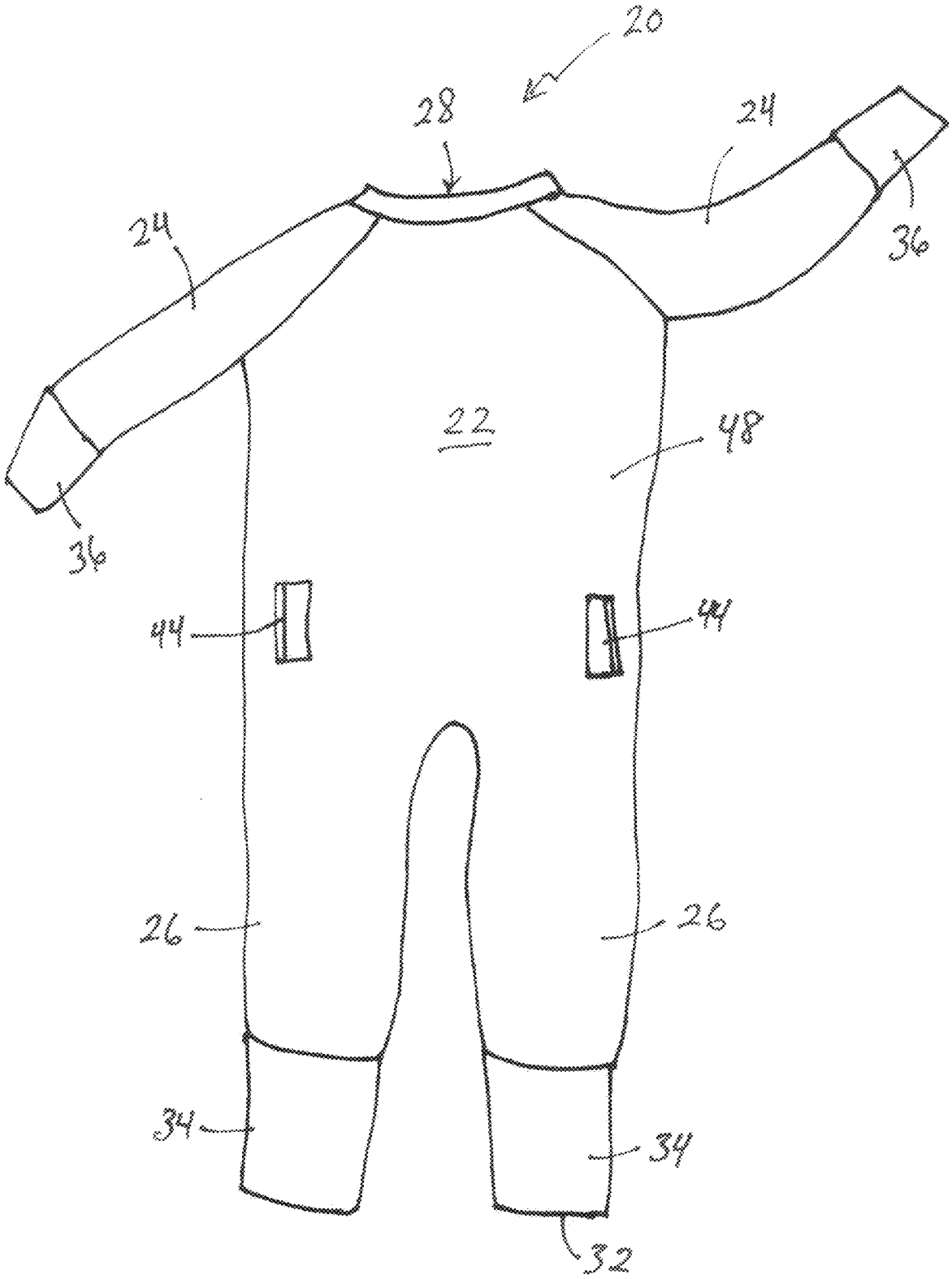
FIG. 4 is a rear view of another embodiment of a premature infant garment.

The garment 20 may include a single slit opening 44, as shown in FIGS. 1 and 3, or two slit openings 44, as shown in FIGS. 2 and 4. Other embodiments may include more than two slit openings 44. Each slit opening 44 may be between about 1 cm and about 10 cm long, or between about 1 cm and about 5 cm long, or between about 2 cm and about 4 cm long.

The slit openings 44 may be located on a front side 46 of the bodice 22, as shown in FIGS. 1 and 2, or on a back side 48 of the bodice 22, as shown in FIGS. 3 and 4. Slit openings 44 can also be located on both the front side 46 of the bodice 22 and the back side 48 of the bodice 22. One benefit of having the slit openings 44 on the back side 48 of the bodice 22 is that the resulting appearance is more discreet and more aesthetically appealing.

According to certain embodiments, the slit openings 44 may be located between the front side 46 of the bodice 22 and the back side 48 of the bodice 22. However, the slit opening 44 does not coincide with any side seams 50 of the bodice 22. It has been found that slit openings 44 that coincide with side seams 50 on the bodice 22 tend to gape open. Since the slit opening 44 does not include any refastenable fasteners, the slit opening 44 should be positioned in a location that does not push the ends of the slit opening 44 together during normal wear, which would result in gaping.

Figure 5A:
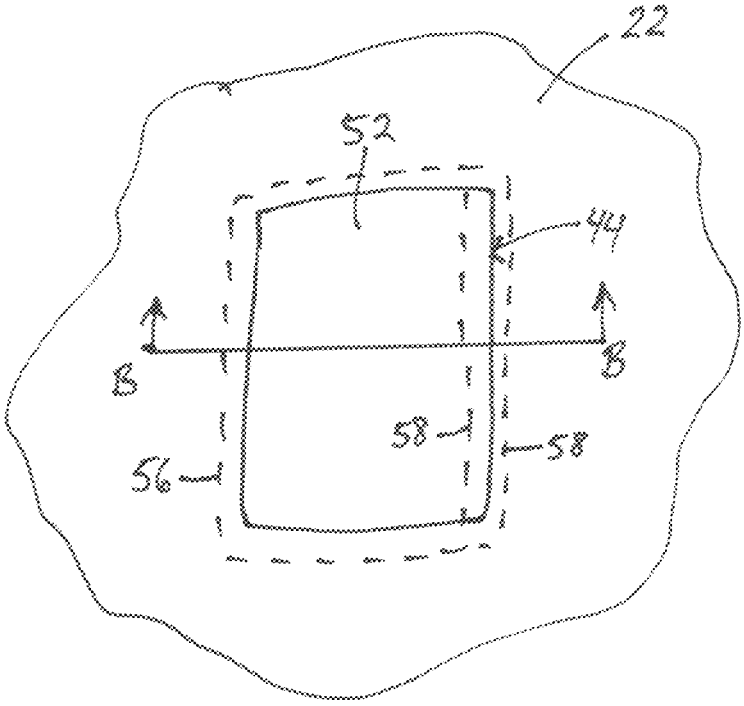
FIG. 5A is a close-up view of a slit opening in a premature infant garment.
Figure 5B:
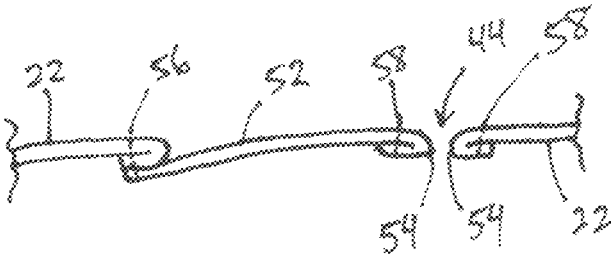
FIG. 5B is a cross-sectional view of the slit opening in FIG. 5A.

The slit opening 44 is a finished opening that is not refastenable. Instead, the slit opening 44 may include overlapping fabric or a fabric inset 52 that is sewn to edges surrounding a cut in the garment 20 to form finished edges 54 along the slit opening 44, as shown in FIGS. 5A and 5B. FIG. 5B shows the stitches 56 that attach the fabric inset 52 to the bodice 22 or other part of the garment 20, as well as the stitches 58 that form the finished edges 54. This construction provides a discreet opening 44 with ample space for wires and tubes. The lack of fasteners in the slit opening 44 provides comfort for the wearer.

The fabric of which the garment 20 is formed may be bamboo for added comfort. Other fabrics, such as cotton or cotton blends, may also be used to form the garment 20. The snug-fitting design of the garment 20 obviates the need for flame-resistant fabric. Like the cuffs 34 at the distal ends 32 of the pant legs 26, the garment 20 may also include cuffs 36 at the distal ends of the sleeves 24. The cuffs 36 may be formed of the same material as the sleeves 24 or of a more ribbed material, for example. Like the cuffs 34 at the end of the pant legs 26, the cuffs 36 at the end of the sleeves 24 ensure that the baby's hands remain accessible for attaching intravenous lines or other medical devices.

The descriptions and figures included herein depict specific implementations to teach those skilled in the art how to make and use the best option. For the purpose of teaching inventive principles, some conventional aspects have been simplified or omitted. Those skilled in the art will appreciate variations from these implementations that fall within the scope of the invention. Those skilled in the art will also appreciate that the features described above can be combined in various ways to form multiple implementations. As a result, the invention is not limited to the specific implementations described above, but only by the claims and their equivalents.

The invention claimed is:

1. A garment for a premature infant comprising:

a bodice from which two sleeves and two pant legs extend, the bodice having a neck opening;

a refastenable seam extending from the neck opening along at least a portion of a length of the bodice; and at least one slit opening on the bodice, wherein the slit opening is a finished opening that is not refastenable and does not coincide with any side seams of the bodice, and the finished opening includes a fabric inset that is sewn to edges surrounding a cut in the garment to form finished edges along the slit opening, wherein the garment is smaller than baby clothing designed to fit full-term babies and has different proportions than baby clothing designed to fit full-term babies, with the two sleeves and the two pant legs being short relative to the length of the bodice compared to baby clothing designed to fit full-term babies.

2. The garment according to claim 1, wherein the garment is a one-piece garment.

3. The garment according to claim 1, wherein the at least one slit opening is between about 1 cm and 5 cm long.

4. The garment according to claim 1, wherein the refastenable seam comprises a zipper.

5. The garment according to claim 1, comprising a single slit opening.

6. The garment according to claim 1, comprising two slit openings.

7. The garment according to claim 1, wherein the at least one slit opening is located on a front side of the bodice.

8. The garment according to claim 1, wherein the at least one slit opening is located between a front side of the bodice and a back side of the bodice.

9. The garment according to claim 1, wherein the refastenable seam extends from the neck opening to one of the two pant legs and extends along at least a portion of a length of the pant leg.

10. The garment according to claim 1, further comprising a cuff at a distal end of each of the two pant legs, wherein the refastenable seam extends from the neck opening to the cuff at the distal end of one of the two pant legs.

11. The garment according to claim 1, wherein the refastenable seam extending from the neck opening along at least a portion of the length of the bodice is the only refastenable seam in the garment.

12. A garment for a premature infant comprising:

a bodice from which two sleeves and two pant legs extend, the bodice having a neck opening;

a refastenable seam including a zipper, wherein the refastenable seam extends from the neck opening along a length of the bodice and along at least a portion of a length of one of the two pant legs; and at least one slit opening on the bodice, wherein the slit opening is a finished opening that is not refastenable and does not coincide with any side seams of the bodice, and the finished opening includes a fabric inset that is sewn to edges surrounding a cut in the garment to form finished edges along the slit opening, wherein the garment is a one-piece garment and wherein the refastenable seam including the zipper is the only refastenable seam in the garment, and wherein the garment is smaller than baby clothing designed to fit full-term babies and has different proportions than baby clothing designed to fit full-term babies, with the two sleeves and the two pant legs being short relative to the length of the bodice compared to baby clothing designed to fit full-term babies.

13. The garment according to claim 12, wherein the at least one slit opening is between about 1 cm and 5 cm long.

14. The garment according to claim 12, comprising a single slit opening.

15. The garment according to claim 12, comprising two slit openings.

16. The garment according to claim 12, wherein the at least one slit opening is located on a front side of the bodice.

17. The garment according to claim 12, wherein the at least one slit opening is located between a front side of the bodice and a back side of the bodice.

18. The garment according to claim 12, further comprising a cuff at a distal end of each of the two pant legs, wherein the zipper extends from the neck opening to the cuff at the distal end of one of the two pant legs.

* * * * *